US008701570B2

(12) United States Patent
Wilson et al.

(10) Patent No.: US 8,701,570 B2
(45) Date of Patent: Apr. 22, 2014

(54) EXPANDABLE MODULAR INTERLOCKING PALLET SYSTEM

(75) Inventors: Daniel Carter Wilson, Marysville, OH (US); Rick Sayman, Marysville, OH (US)

(73) Assignee: Capstone Innovations, LLC, Marysville, OH (US)

( * ) Notice: Subject to any disclaimer, the term of this patent is extended or adjusted under 35 U.S.C. 154(b) by 0 days.

(21) Appl. No.: 13/341,431

(22) Filed: Dec. 30, 2011

(65) Prior Publication Data

US 2012/0298014 A1 Nov. 29, 2012

Related U.S. Application Data

(60) Provisional application No. 61/490,773, filed on May 27, 2011.

(51) Int. Cl.
*B65D 19/12* (2006.01)

(52) U.S. Cl.
USPC ..... 108/56.1; 108/54.1; 108/64

(58) Field of Classification Search
USPC ..... 108/64, 51.11, 53.3, 54.1, 56.1; 248/346.02; 206/386, 595, 600
See application file for complete search history.

(56) References Cited

U.S. PATENT DOCUMENTS

| | | | | | |
|---|---|---|---|---|---|
| 2,919,875 | A | * | 1/1960 | Mendel | 108/57.29 |
| 3,500,770 | A | | 3/1970 | Skubic | |
| RE26,873 | E | | 4/1970 | Mollon | |
| 3,561,374 | A | * | 2/1971 | Honderich | 108/57.22 |
| 3,650,224 | A | * | 3/1972 | Petix et al. | 108/54.1 |
| 3,709,165 | A | | 1/1973 | Blozis | |
| 3,750,596 | A | | 8/1973 | Box | |
| 3,754,645 | A | | 8/1973 | Kilroy | |
| 3,756,396 | A | | 9/1973 | Kilroy | |
| 3,824,933 | A | | 7/1974 | Lind | |
| 3,853,072 | A | | 12/1974 | Skubic et al. | |
| 3,857,342 | A | | 12/1974 | Johns | |
| 4,062,301 | A | * | 12/1977 | Pitchford | 108/56.1 |
| 4,095,769 | A | * | 6/1978 | Fengels | 248/346.02 |
| 4,165,908 | A | * | 8/1979 | Cooper et al. | 108/64 |
| 4,228,744 | A | | 10/1980 | Moore | |
| 4,378,743 | A | | 4/1983 | McFarland | |
| 4,694,962 | A | * | 9/1987 | Taub | 206/600 |
| 4,895,080 | A | | 1/1990 | Thomas | |
| 5,025,735 | A | | 6/1991 | Chan et al. | |
| 5,094,175 | A | | 3/1992 | Christie | |
| 5,096,112 | A | | 3/1992 | Grigsby | |
| 5,105,746 | A | | 4/1992 | Reynolds | |
| 5,158,329 | A | | 10/1992 | Schlack | |
| D347,511 | S | | 5/1994 | Pigott et al. | |
| 5,351,627 | A | * | 10/1994 | Junaedi | 108/56.1 |
| 5,483,899 | A | | 1/1996 | Christie | |

(Continued)

*Primary Examiner* — Jose V Chen
(74) *Attorney, Agent, or Firm* — Hahn, Loeser & Parks LLP; Arland T. Stein

(57) ABSTRACT

An expandable modular interlocking pallet system comprises a plurality of elongated modules, each including a lattice array for supporting a load. The module includes a first side having two female tracks and a second side opposite the first having two complementary male tracts adapted to interlock with the female tracks of an adjacent module. The module also includes a slam latch nested in the module which may engage a striker positioned on an adjacent module. The striker allows for disassembly of the pallet system as desired. Passageways are provided in each module that allow forks of a lift truck or the like to move the interlocked pallet.

22 Claims, 8 Drawing Sheets

(56) References Cited

U.S. PATENT DOCUMENTS

| | | | | |
|---|---|---|---|---|
| 5,562,047 | A * | 10/1996 | Forney et al. | 108/57.13 |
| 5,568,774 | A | 10/1996 | Hutchison | |
| 5,579,700 | A | 12/1996 | Nuechterlein et al. | |
| 5,582,113 | A | 12/1996 | Langenbeck | |
| 5,603,266 | A | 2/1997 | Nash | |
| 5,603,535 | A | 2/1997 | Antonucci et al. | |
| 5,676,067 | A | 10/1997 | Breindel | |
| 5,791,261 | A | 8/1998 | John et al. | |
| 5,809,905 | A | 9/1998 | John et al. | |
| 5,829,364 | A | 11/1998 | Urbach | |
| 5,860,369 | A | 1/1999 | John et al. | |
| 5,887,529 | A | 3/1999 | John et al. | |
| 6,050,618 | A | 4/2000 | Tieu | |
| 6,234,087 | B1 * | 5/2001 | Brown | 108/56.1 |
| 6,234,088 | B1 * | 5/2001 | Bredal et al. | 108/91 |
| 6,263,807 | B1 * | 7/2001 | Fox et al. | 108/57.25 |
| 6,354,228 | B1 | 3/2002 | McPhee et al. | |
| 6,354,230 | B1 | 3/2002 | Maschio | |
| 6,418,861 | B1 | 7/2002 | Flam | |
| 6,622,879 | B1 * | 9/2003 | Carter | 220/23.4 |
| 6,659,019 | B2 * | 12/2003 | Gruber et al. | 108/53.5 |
| 6,837,170 | B2 | 1/2005 | Taft | |
| 7,007,613 | B2 | 3/2006 | Sketo | |
| 7,107,913 | B2 * | 9/2006 | Smith | 108/64 |
| 7,128,350 | B2 | 10/2006 | Eckerdt | |
| 7,318,532 | B1 | 1/2008 | Lee et al. | |
| 7,322,299 | B2 * | 1/2008 | Greene | 108/56.1 |
| 7,360,493 | B2 | 4/2008 | Hummel et al. | |
| 7,491,024 | B2 | 2/2009 | Heinrichs et al. | |
| 7,517,180 | B2 | 4/2009 | Baker | |
| 7,681,735 | B2 | 3/2010 | Youell, Jr. | |
| 7,739,965 | B2 | 6/2010 | Heinrichs et al. | |
| 7,802,527 | B2 * | 9/2010 | Dong | 108/56.1 |
| 7,938,570 | B2 | 5/2011 | Lee et al. | |
| 8,176,857 | B2 * | 5/2012 | Ochs | 108/64 |
| 2002/0174807 | A1 | 11/2002 | Mason | |
| 2005/0102918 | A1 | 5/2005 | Richardson et al. | |
| 2007/0107639 | A1 | 5/2007 | Dixon | |
| 2007/0140805 | A1 | 6/2007 | Johnson et al. | |
| 2007/0217883 | A1 | 9/2007 | Heinrichs et al. | |
| 2008/0060561 | A1 | 3/2008 | Carrasco | |
| 2008/0066657 | A1 | 3/2008 | Kuo | |
| 2008/0127865 | A1 | 6/2008 | Tung-Cheng | |
| 2008/0190872 | A1 | 8/2008 | Scollon et al. | |
| 2009/0241810 | A1 | 10/2009 | Lauzier et al. | |

* cited by examiner

EXPANDABLE MODULAR INTERLOCKING PALLET SYSTEM

This application claims priority to provisional application No. 61/490,773 filed May 27, 2011 and titled "Modular interlocking pallet system which uses repeating identical pieces to make pallets of various lengths" and incorporates by reference the entire contents thereof.

BACKGROUND AND SUMMARY OF THE INVENTION

The present invention relates to a modular pallet system. Pallets are valuable components in the transport of goods, both raw materials and finished goods, and are used in nearly every facet of modern shipping, product transport, and storage. Pallets are widely used to provide a portable platform for handling, shipping, and storing materials. Materials may be placed on a pallet in one facility, shipped to and stored in another, and transported to a third without the need to load and unload the shipped material from the pallet. Further, the materials may be transported to or from a storage, shipping, or work location within a facility with minimal effort.

The most popular and widely used pallets are formed from multiple levels of transverse support elements. In one embodiment, top slabs (on which material is placed) are secured to transverse support elements that elevate the slabs from the ground. These transverse support elements may be assembled to bottom transverse slabs to complete the pallet. The transverse support elements are spaced and selected to allow forks from a lift truck to engage, elevate and transport the pallet from one location to another, with or without materials onboard. In the most popular variation of these pallets, the top and bottom slabs and transverse support elements are formed of wood.

These popular pallets are preferred because they are inexpensive to manufacture, have a reasonably long shelf life (longer if the slabs and transverse elements are made of a more durable material such as plastic), can support a great deal of weight, are interchangeable with one another, of a standard size and consistently manufactured. Pallet construction may be evaluated based on weight, cost, structural strength, versatility, ease of transportation, and reusability.

One existing problem with current pallet systems is over- or under-sized packages that may need to be transported. This problem creates a need for customized pallet construction in order to properly support and transport material.

A number of alternative pallet arrangements have been proposed, including modular pallets, plastic pallets, or pallets of different designs of the standard wooden pallet. The disadvantages of these pallets will become apparent from the following discussion of these systems.

U.S. Pat. No. 5,582,113 to Langenbeck describes a modular pallet that is constructed from molded plastic pallet members. This modular pallet may be assembled into a variety of sizes; however as can be appreciated from the various figures of the application, assembly of the various components to one another is complicated and time consuming. Further, the apparatus described by Langenbeck shows the use of "deflectable tines" useful to "secure the pallet members . . . to each other," as shown in FIG. 10, but these tines are not easily accessible and may be difficult to operate.

U.S. Pat. No. 5,483,899 to Christie also discloses a modular pallet that may be constructed of plastic or other durable materials. This modular pallet system, like Langenbeck, utilizes interlocking sections to form a pallet. However, Christie describes separate, non-uniform sections which must be secured to one another in order to form the pallet structure. Further, like Langenbeck, the structure useful for securing various components together are deflectable tines (FIG. 5), which may be difficult to access and operate.

U.S. Pat. No. 5,809,905 to John et al. discloses a modular system that incorporates a lattice structure and interlocking elements and may be formed of plastic or other material. However, like the previous applications, John et al. describes a separate, non-integrally mounted structure (center locking ring 46, FIG. 1) to secure the modular elements to one another. Further, John et al. is not expandable beyond the predetermined size shown in the preferred arrangement.

As evident from the prior art systems, there exist problems with the current state of the art in modular pallet systems. First, there is realized a need for a modular pallet system which may be expandable beyond the standard pallet size to accommodate oversized materials. Second, there is realized a need for a modular system having an integrally mounted or integrally formed locking or latching system for securing modular pallet systems to one another. Finally, there is recognized a need for an inexpensive high-strength, low-cost pallet system which may replace or supplement existing available pallet systems.

Disclosed is an expandable modular pallet system comprising a number of elongated modules each sized to be a fraction of a desired pallet size. The modules may have a lattice array with the strength to support a load. Each module has two female tracks on a first side and male tracks on an opposite second side such that female tracks can engage male tracks of an adjacent like module and are adapted to interlock as desired to assemble a pallet of the desired size. Each module also includes at least one and usually at least two slam latches nested in the module which engage a striker on an adjacent module to lock the modules together. The slam latch may be disengaged to permit disassembly of the modules.

Each module also includes passageways to permit placing forks of a fork lift under the assembled pallet, with or without materials loaded on the pallet. Additionally, each module may include a notch adapted to enable a strap tie that extends between the first and second sides and engage a load on the pallet. The male tracks may be U-shaped with extending tabs that engage the female tracks of an adjacent module.

Each module may include three male and female tracks on opposite sides, positioned to engage complementary tracks on adjacent modules, and at least two slam latches and corresponding strikers on opposite sides, positioned to engage strikers on adjacent modules. This way a pallet system of like modules can be assembled and interlocked of a desired size. Each slam latch may be mechanically biased, for example, by a mechanical spring, to engage the striker of an adjacent module. Further, the end portions of the modules may be angular to enable the modules to nest and be stacked on one another.

As a result, a pallet system is assembled by engaging adjacent modules in an expandable modular interlocking pallet system. The modules may include a lattice structure extending between a front, back, and two sidewalls. The lattice structure supports a load on the modules. A vertical projection or stop extends from the first side and has a profile for locking the module to an adjacent module of like construction. A vertical groove extends along the second side opposite the first side and includes a profile complementary to the vertical projection for locking the module to an adjacent module. A striker is provided on one of side of the module and a slam latch is provided on the opposing side of the module with the slam latch movable between a locked position where it engages the striker of the adjacent module and an unlocked position where it disengages the striker of the adjacent module. The slam latches are also removable so that broken slam latches can be removed and replaced by new slam latches Also disclosed is a method of assembling a modular pallet system of a desired size. The method includes providing a number of like modules, each with a first side with a male connector and opposite second side with a female connector having a stop such that adjacent modules can be assembled and interlocked. The male connector of each module is inserted into any female connector of an adjacent module until it engages the stop. A slam latch and striker are also provided on opposite sides of each module adapted to engage and lock modules in assembly of the modules in forming a pallet system. The slam latch on one side of each module engages a striker of the opposite side of an adjacent module, thereby securely locking the two adjacent modules together. A number of modules may be assembled in this manner until the pallet system of the desired size is provided.

DETAILED DESCRIPTION OF DRAWINGS

Several embodiments of the invention will now be described with reference to the attached figures wherein numerals correspond to their like in the following description.

Figure 1:
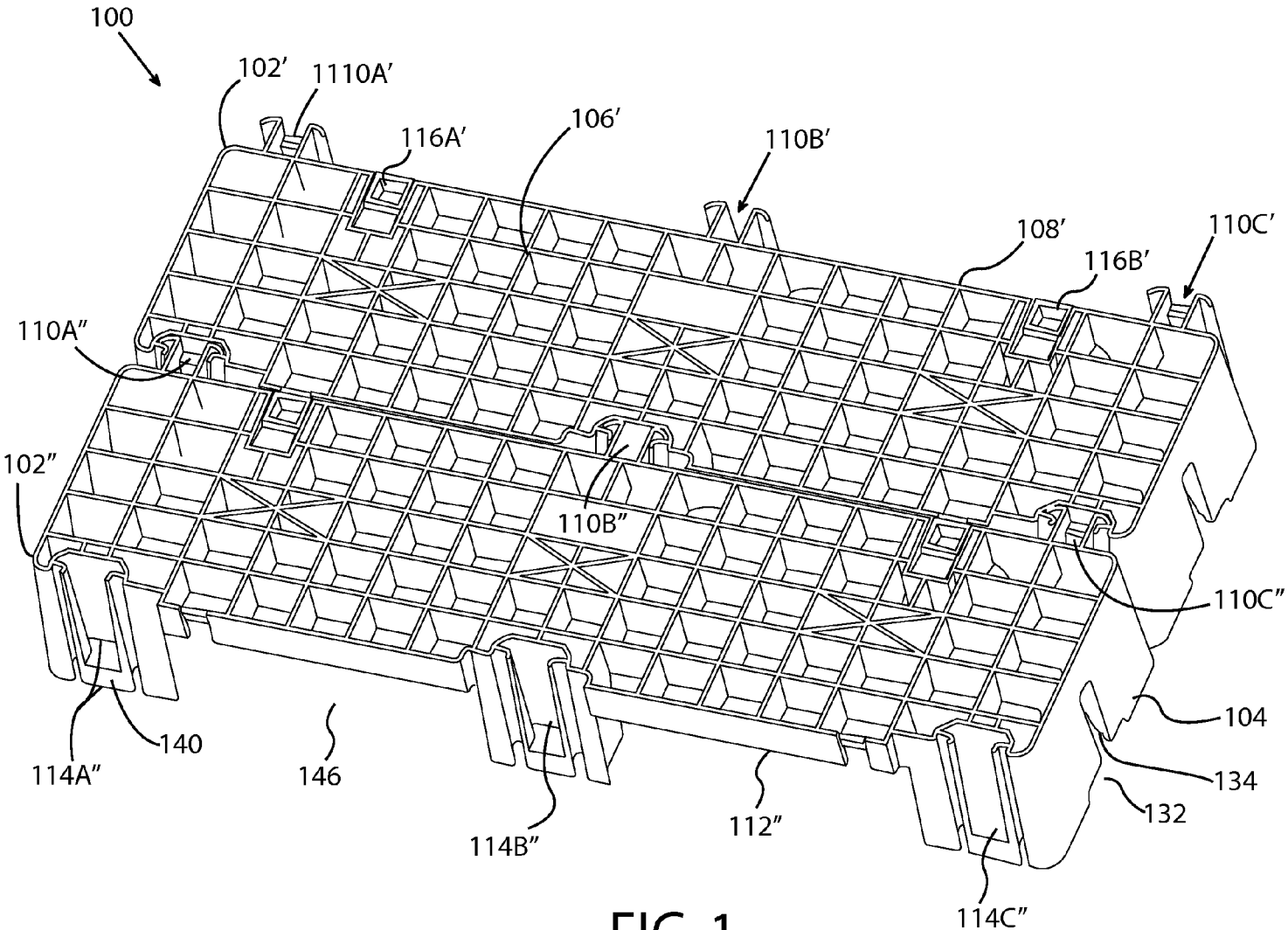
FIG. 1 is a perspective view of the modular pallet system.

As shown in FIG. 1, a pallet section 100 assembled according to the expandable modular interlocking pallet system may include first 102' and second 102" pallet modules (referred to generally as modules 102) connected to form the pallet section 100. Two pallet modules 102' and 102" are shown connected here, but it will become apparent that any number of modules may be connected to form a larger pallet section.

Figure 2:
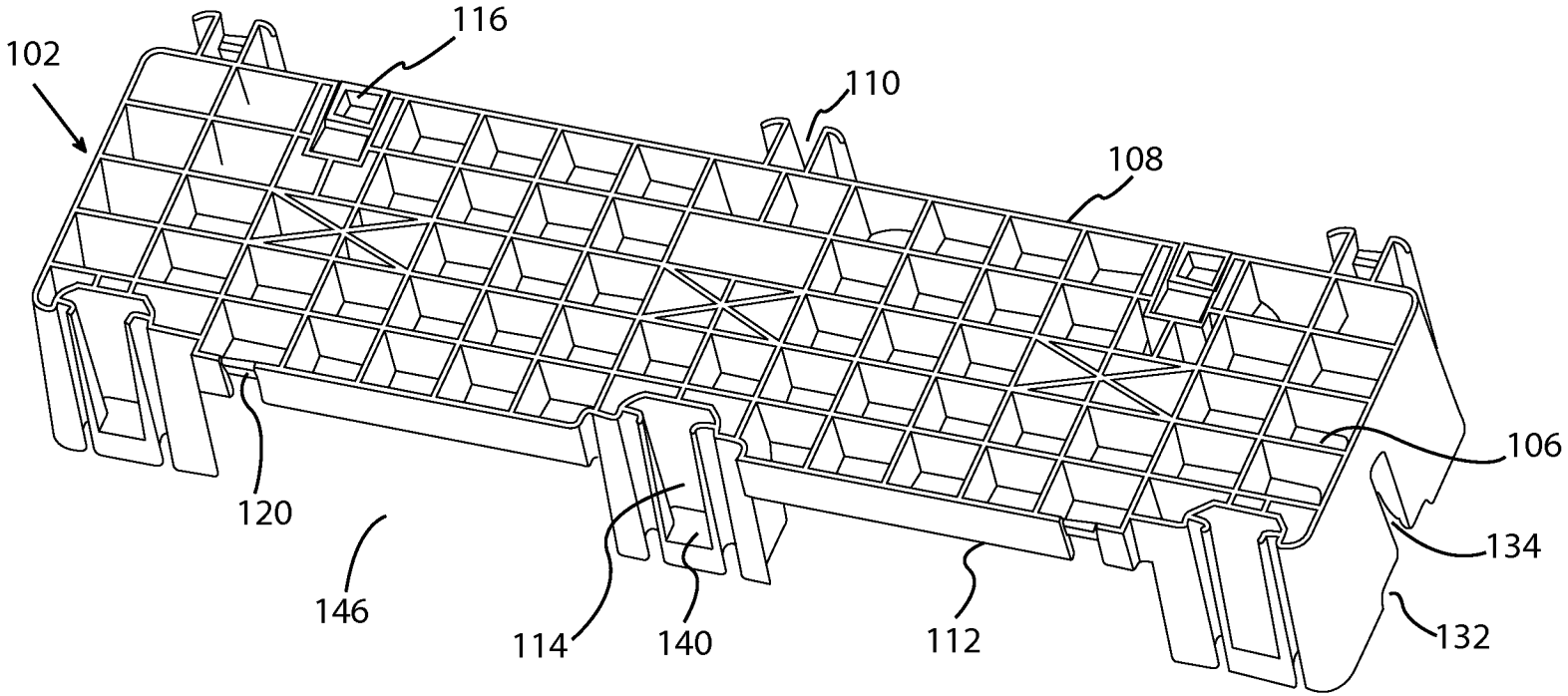
FIG. 2 is a perspective view of one of the modules shown in FIG. 1.
Figure 3:
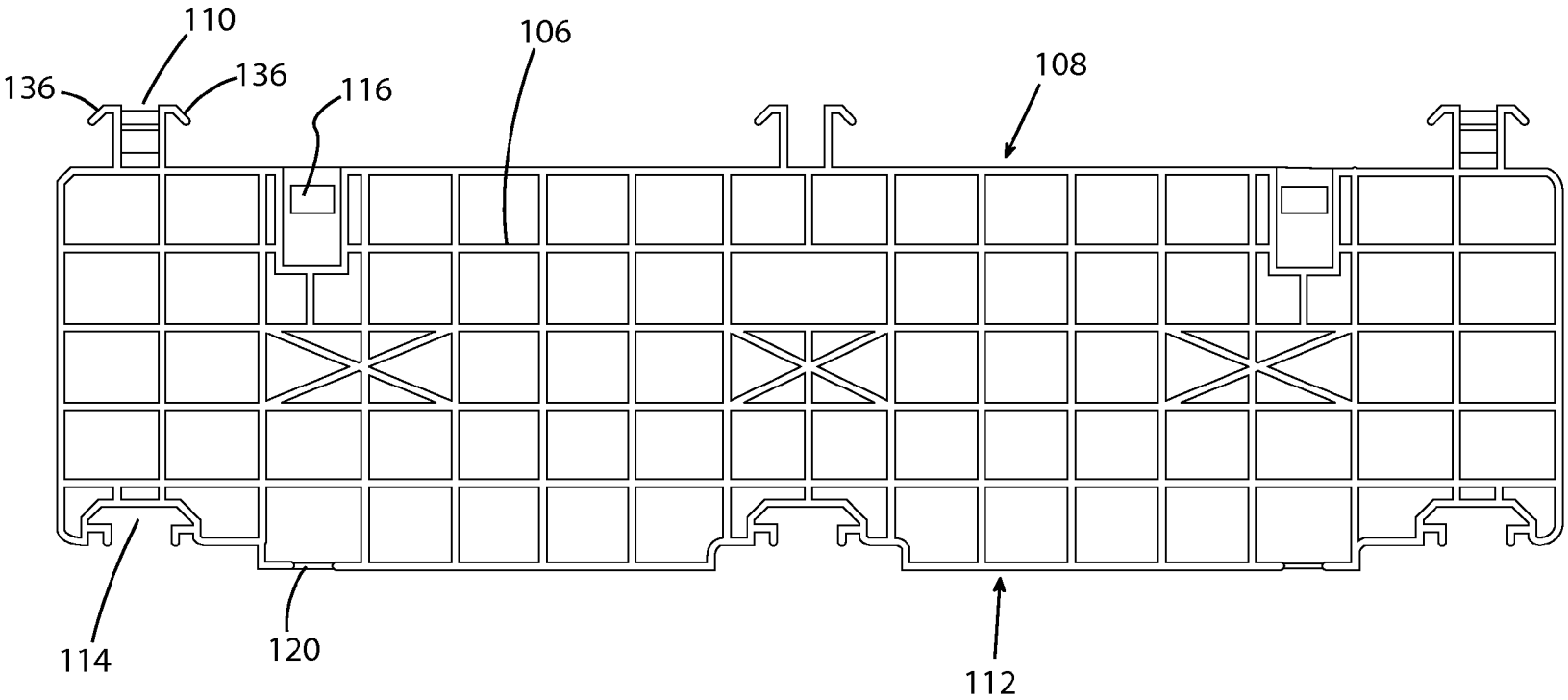
FIG. 3 is a top view of the module shown in FIG. 2.

FIGS. 2-3 show a single module 102 in further detail. FIG. 2 shows the module in perspective as removed from the pallet section 100 shown in FIG. 1; FIG. 3 shows a top view of the module 102. As shown in these figures, the pallet module 102 may include a pair of sidewalls 104 between which extends a lattice structure 106 for supporting a load. Along a front side 108 of the module 102 are located a number of vertical projections 110A-C (referred to generally as 110) and along a back side 112 of the module 102 are a number of vertical grooves 114A-C (referred to generally as 114). These projections 110 and grooves 114 interlock to provide the modularity of the system, as may be appreciated with reference to FIG. 4. Also shown in FIGS. 1-3 are secondary connecting structure 116A, B that provide additional structural support between the first 102' and second 102" pallet modules. These secondary connecting structure 116 are shown in further detail in FIGS. 5-8 and described with reference thereto.

Figure 4:
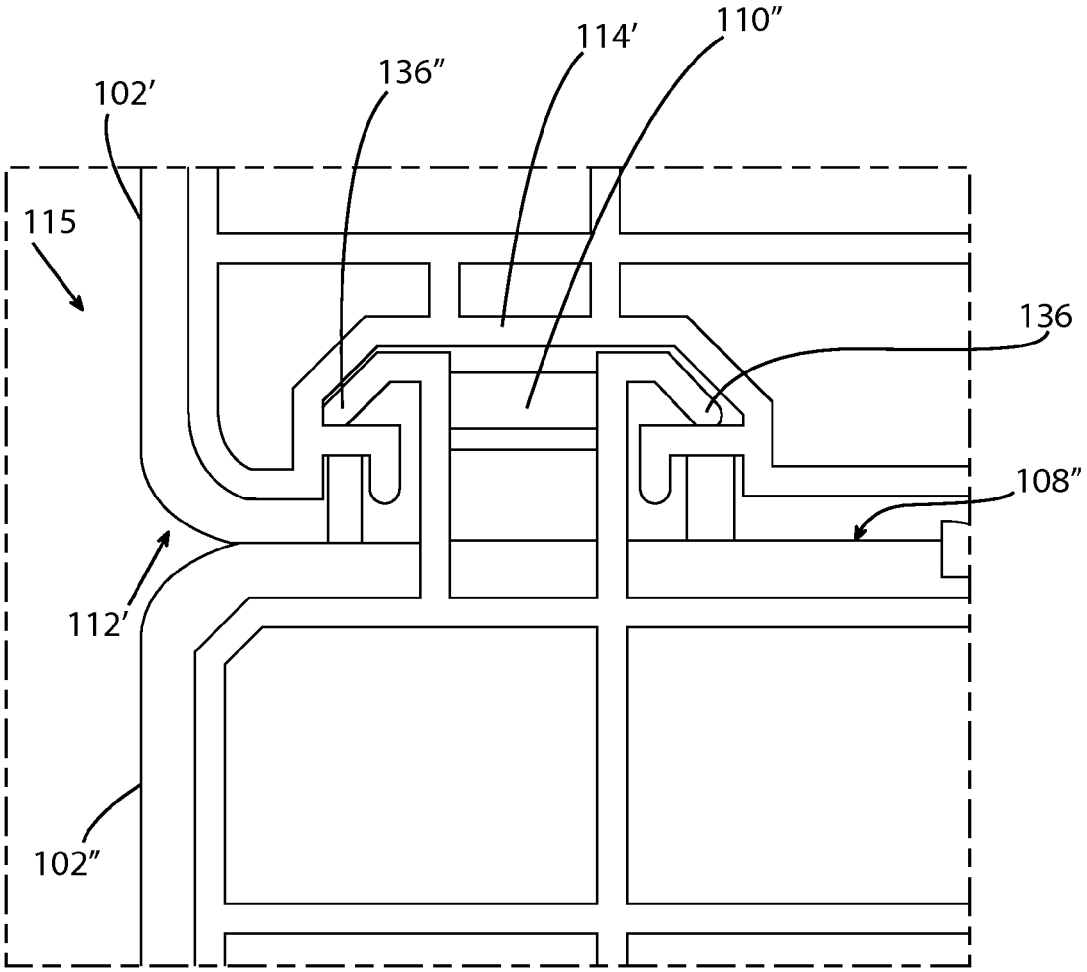
FIG. 4 is a top view showing the connection point between the modules in FIG. 1.

FIG. 4 shows a top view of the interface between the first 102' and second 102" modules by means of one vertical projection 110 on the first module 102' and one vertical grooves 114 on the second module 102". The interlocked vertical projection 110 and groove 114 is referred to generally as the primary connecting structure 115. As shown, the vertical projection 110 is shaped to be received within the vertical groove 114 so as to secure the modules 102', 102" to one another in an abutting relationship.

Figure 5:
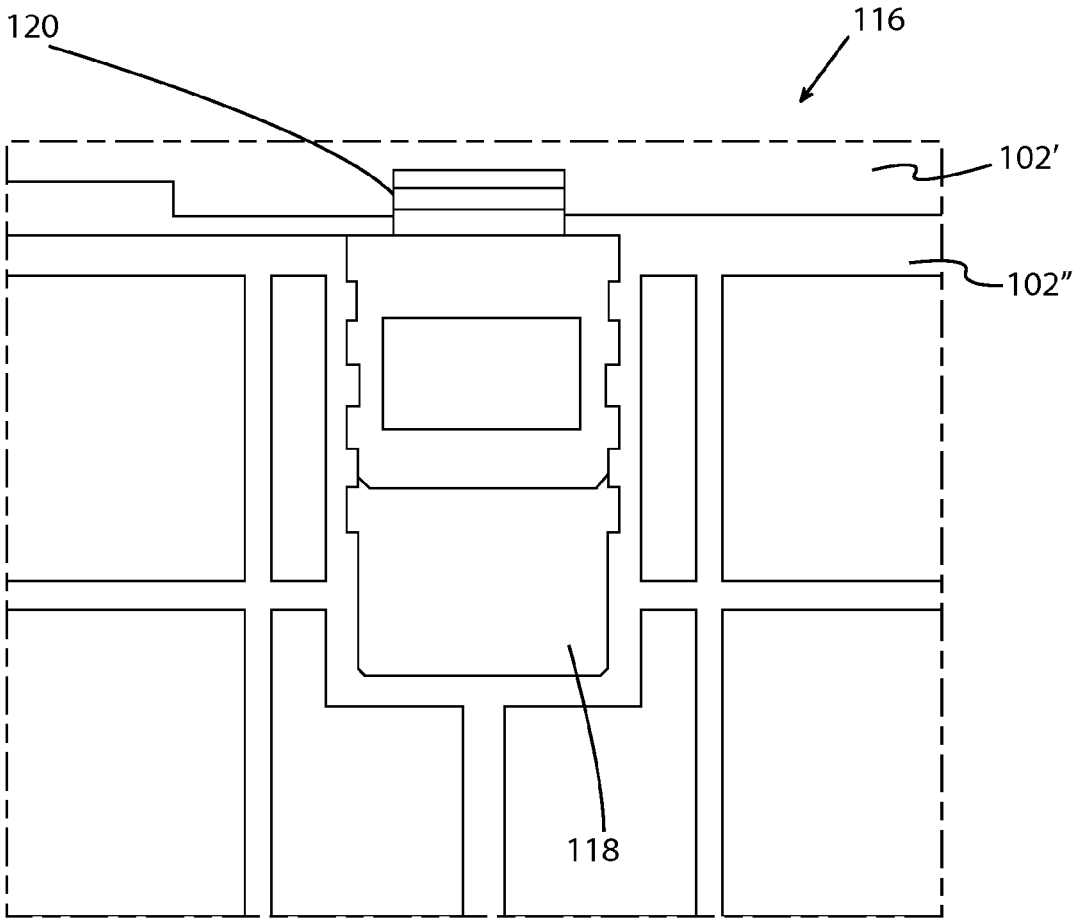
FIG. 5 is a top view of secondary connecting structure between the modules in FIG. 1.

FIG. 5 shows the secondary connecting structure 116 in further detail. The secondary connecting structure 116 may include a slam latch 118 on the first module 102' and a lip 120 or striker on the second module 102" that receives or engages a portion of the slam latch 118 when engaged. When the slam latch 118 is engaged with the lip 120 of an adjoining module 102 the modules 102 are not free to move vertically relative to one another, and therefore the vertical projections 114 cannot be removed from the vertical grooves 114.

Figure 6:
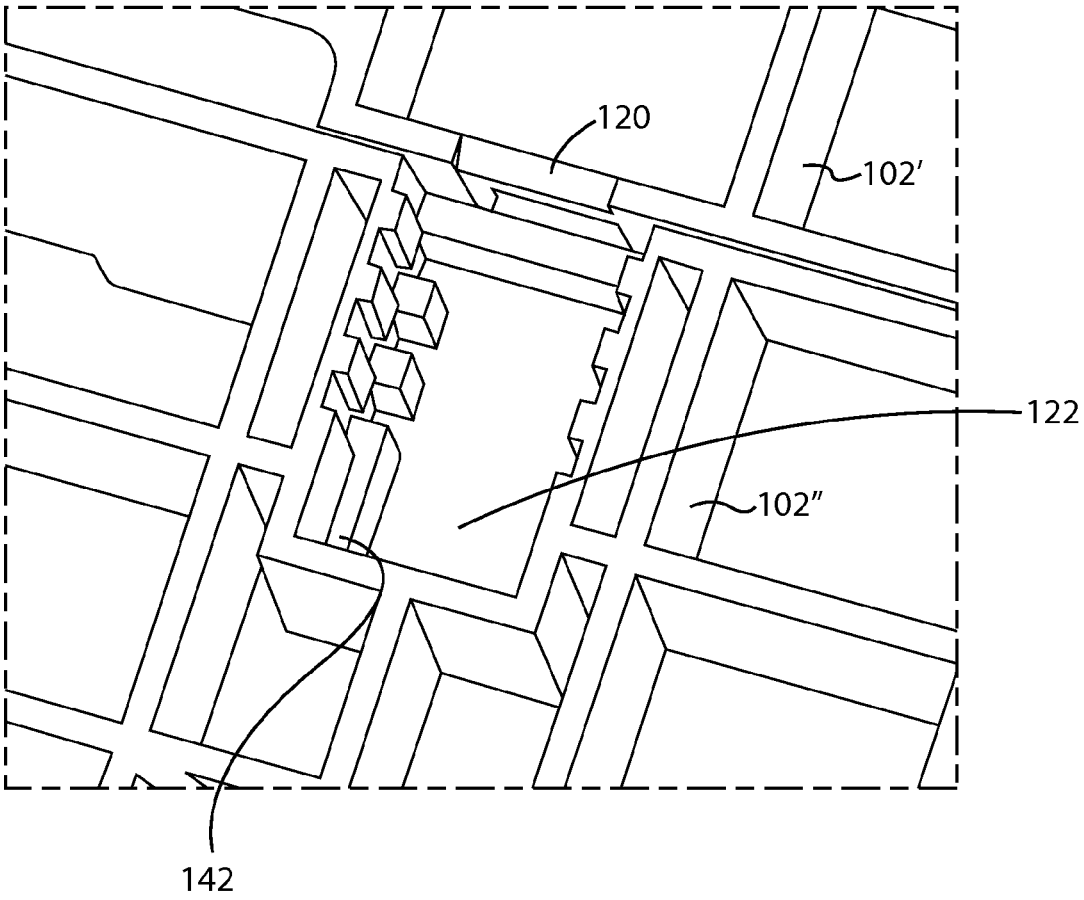
FIG. 6 is a top view of the modules in FIG. 1 with the secondary connecting structure removed.

FIG. 6 shows the interface between the first 102' and second 102" modules with the slam latch 118 removed. As shown, at this location the first module 102' includes a recess 122 for receiving the slam latch and the second module includes a lip 120 which is engaged by a portion of the slam latch 118 as described above.

Figure 7:
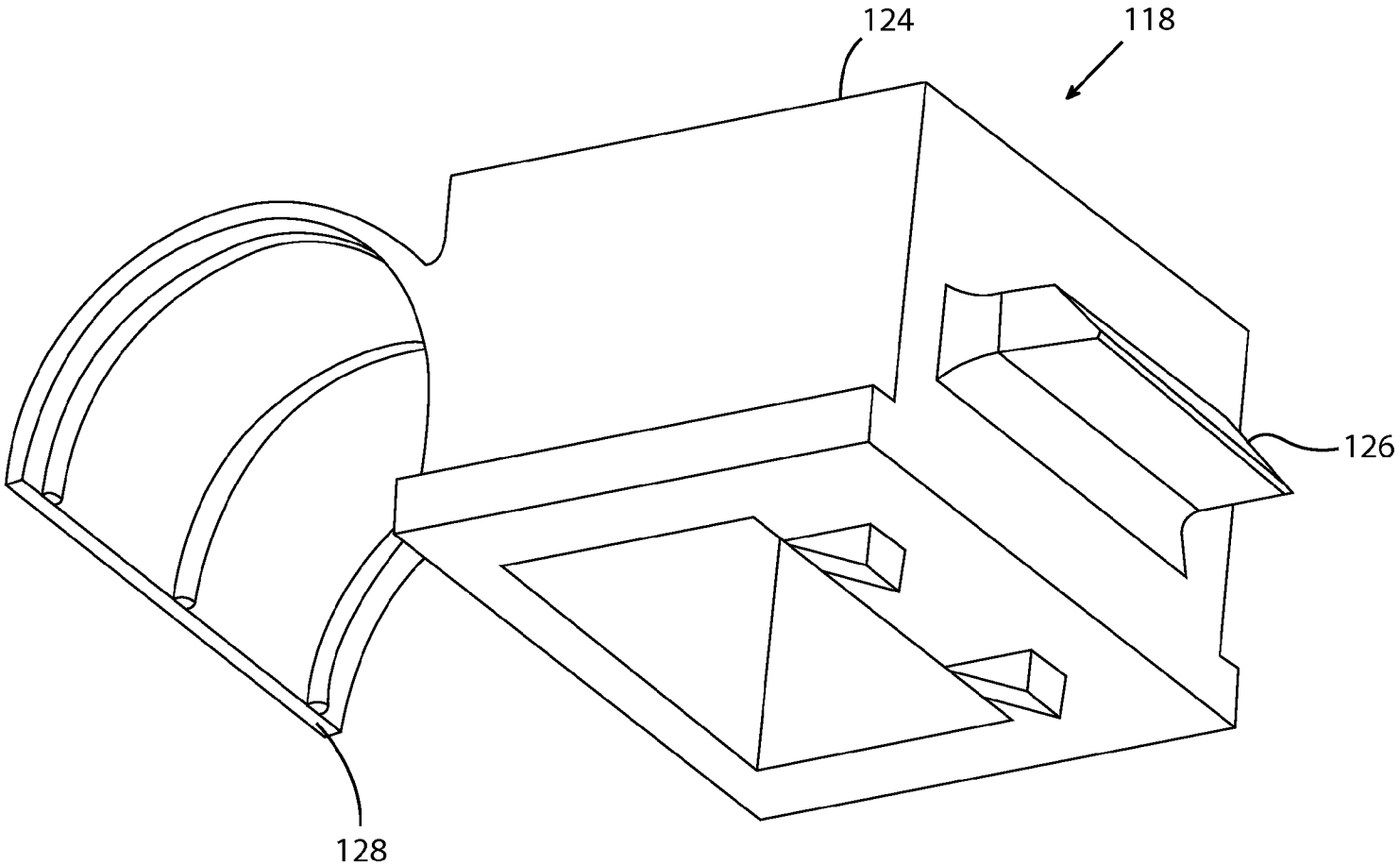
FIG. 7 is a perspective view of the secondary connecting structure separated from the modules in FIG. 1.

FIG. 7 shows a perspective view of the slam latch 118 according to one embodiment. As shown, the slam latch 118 generally includes a body element 124, latching element 126 and spring element 128. The housing element 124 may include a hollow 130 (FIG. 8) that may accommodate a hand or tool to adjust the slam latch 118 between a secured (where the latching element 126 engages the lip 120) and an unsecured position (where the latching element 126 does not engage the lip 120). The latching element 126 is designed to engage the lip 120 (FIG. 6) of an adjoining module and prevent vertical movement of the modules relative to one another. The spring element 128 biases the slam latch 118 in a secured position and allows the latch to be moved to an unsecured position for disassembly of the pallet modules 102 (FIG. 1) from one another.

Figure 8:
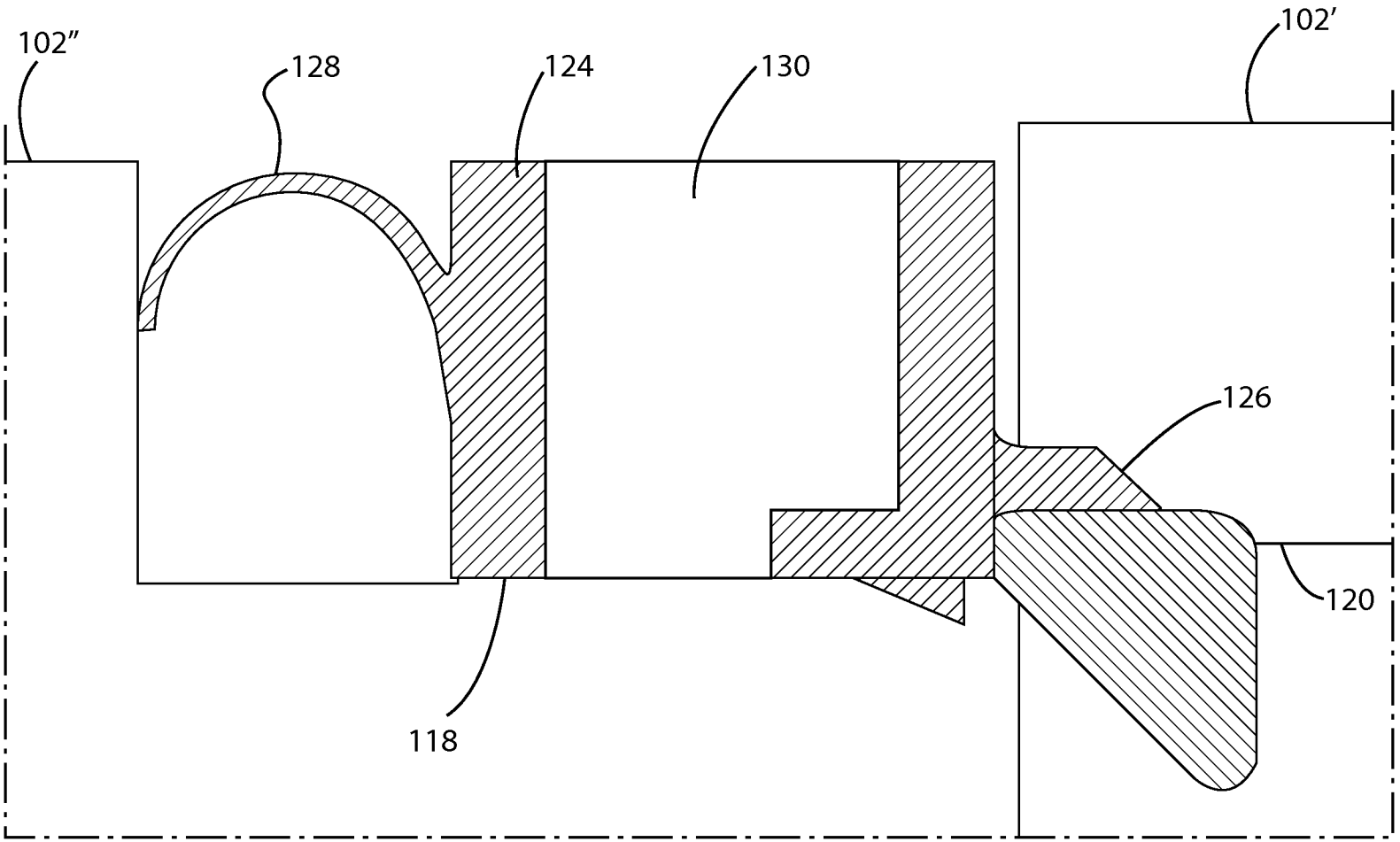
FIG. 8 is a cutaway side view of the secondary connecting structure taken along line 8-8 in FIG. 5.

FIG. 8 shows a cross sectional view of the slam latch 118 in a secured position where the latching element 126 of a first module 102' engages the lip 120 of a second module 102". As previously described, this engagement prevents the second module 102" from moving vertically relative to the first module 102'.

According to one embodiment of the invention the pallet module 102 may be formed of extruded, foamed, or injection-molded plastic, such as thermoset, thermoplastic, polyvinyl chloride, or other rigid or semi-rigid plastic. Alternatively, the pallet modules 102 may be formed of metal, epoxy, or other synthetic, semi-synthetic, or natural material. According to one embodiment, the pallet module 102 has a width dimension (between sidewalls 104) of 40 inches, a length dimension (between front 108 and back 112 sides) of 12 inches, and a height dimension of 6 inches. These dimensions allow that four modules 102 may be combined to produce a pallet having a standard size of 40"×48". Further, the sidewalls 104 of the modules 102 may be angled at approximately 3-6° so that modules may be stacked on one another in a nesting relationship.

FIG. 1 shows that each sidewall 104 may include either, both, or neither of a fork access opening 132 and a crossbanding notch 134. The fork access opening 132 may be sized and shaped to accommodate the forks of a lift truck or the like so that the pallet section 100 may be moved or adjusted from one side. The fork access opening 132 may be integrally formed within each sidewall 104 as shown or may be cut, milled, or otherwise removed from the sidewall.

The crossbanding notch 134 may extend upward from the fork access opening 132 to form a space for receiving a strap or band (not shown) over a product or load (not shown) placed on the pallet 100. This notch 134 restricts movement of the strap or band, preventing slippage of the band which may require a new banding operation or could result in damage to the transported load. As with the fork access opening 132, the crossbanding notch 134 may be integrally formed in the sidewall 104, formed in a separate operation, or may be omitted entirely.

As further shown in FIG. 1, each module 102 may include an access area 146 for receiving a fork from a lift truck or the like. The access area 146 is perpendicular to the fork access opening 132 and forks from a lift truck engaging the section 100 from this position would engage multiple modules 102, providing a stronger support surface. It is preferred that these access areas 146 are used when transporting the assembled pallet sections 100.

Also shown in FIG. 1 is that the top of each module 102 may include a lattice structure 106. The lattice structure 106 is shown as an array of squares, however it will be appreciated that the lattice structure 106 may comprise triangles, hexagons, circles, or other shapes in a geometric pattern. The lattice structure may be formed by injection molding as described above or may be formed of interlocking or intersecting elements.

The lattice structure 106 is also shown as having a number of smaller elements (squares in the case illustrated) in length and crosswise directions that make up the lattice structure 106. It will be understood by those having skill in the art that the number and arrangement of these elements may be varied in order to increase or reduce the strength and other properties of the lattice structure 106. For example, by reducing the size of each element and increasing the number of elements the strength of the lattice structure 106 to support a load may be increased. By increasing the size of each element and reducing the number of elements, the weight, manufacturing cost, and load capacity of the lattice structure 106 may be reduced. Therefore, it will be appreciated that a tighter lattice structure 106 (with smaller and more numerous elements) may be effective for industrial uses while a looser lattice structure 106 (with larger and fewer elements) may be effective for private or household use, such as shelving units or storage pallets.

Also shown in FIG. 1 and illustrated in further detail in FIGS. 2-4, the front 108 of the module 102 may include a number of vertical projections 110. These vertical projections 110 extend from the front 108 of the module and extend vertically the width of the module 102. The projections 110 may have a single profile along the width of the module 102 or may vary in cross-sectional profile and may be tapered, include tabs, or otherwise vary. As shown, the vertical projections 110 may be U-shaped with protruding tabs 136 or lips, alternatively the tabs 136 may be turned inwards (not shown), may be non-symmetrical, or may be omitted entirely.

Complementary to the vertical projections 110 are vertical grooves 114 on the back side 112 of the module 102. These vertical grooves 114 correspond in shape, profile, number, and arrangement to the vertical projections 110 on the front side 108 of the module 102. According to the embodiment illustrated in FIGS. 1-4, the vertical grooves 114 may include channels 138 which may receive the tabs 136 of the vertical projections 110 to thereby lock the modules 102 together and prevent the modules 102 from moving relative to one another. This interlocking relationship may be formed by a number of arrangements including the illustrated U-shaped projections with protruding tabs 136, a wedge or other tapered arrangement, or some other keyed relationship. Further, while the modules 102 are shown to include three sets of equally spaced protrusions 110 and gaps 114, it is anticipated that each module 102 may include a variety of number and arrangements of these interlocking members. The wedges 110 and gaps 114 may also be referred to as male and female connectors due to their interlocking relationship.

Each module 102 may also include a stop 140 positioned within the vertical groove 114 that limits the downward travel of a corresponding vertical protrusion 110. This stop 140 is positioned to allow the vertical protrusion 110 to extend into the vertical groove 114 to a depth so that adjacent lattice structures 106 are flush, thereby forming a continuous smooth surface. The stops 140 shown in FIG. 1 are angled so that as more weight is applied the vertical projection 110 and groove 114 are seated to a greater degree and material is less likely to accumulate between the surfaces. However, it should be appreciated that the stop 140 may be flat, textured, or otherwise arranged to prevent downward movement of the vertical projection 110 in the vertical groove 114. As with other components, the stop 140 is shown as integrally formed with the module 102, however it will be appreciated that the stop 140 may comprise additional structure, such as a metal locking pin or other separate component.

The secondary connecting structure 116 is shown in further detail in FIGS. 5-8. As shown in FIG. 5, the secondary connecting structure 116 includes a slam latch 118 on a module 102 and a lip 120 on an adjacent module. As will be understood from the above discussion, the primary interface between two adjacent modules 102 is by means of the vertical projection 110 and vertical groove 114. The intersection of these components restricts horizontal movement of the modules 102 relative to one another and prevents downward vertical movement by means of the stop 140. The secondary connecting structure 116 restricts movement of the vertical protrusion 110 upwards relative to the vertical groove 114, thereby fully constraining movement of the modules 102 relative to one another.

The intersection of two adjacent modules 102', 102" with the slam latch 118 (FIG. 5) removed is shown in FIG. 6. The first module 102' may include a recess 122 which receives the slam latch 118 and generally aligns with the lip 120 of the adjacent module 120". Therefore, as will be appreciated by those having skill in the art, when the slam latch 118 is placed within the recess 122, the latching element 126 will engage the lip 120 of the adjacent module 120" and secure the modules together. The recess 122 may also include a nook 142 for receiving and securing the slam latch 118.

As shown in FIG. 7, the slam latch 118 may be a piece separately formed from the module 102 and may include a ledge 144 for securing the slam latch 118 to the module 102, for example by inserting the ledge 144 within the nook 142 of the recess 122 (FIG. 6). As described above, the slam latch 118 may also include body 124, latching 126, and spring 128 elements with a hollow 130 (FIG. 8) formed within the body element 124. The ledge 144 is undersized for the size of the recess 122 so that the body element 124 of the slam latch 118 may be moved horizontally.

The spring element 128 is shown to be a mechanical bent spring that in an unloaded state has a semi-circular profile. The spring element 128 is supported between the body element 124 and the module 102 (FIG. 8) so that as the body element 124 is moved rearward so as to disengage the latching element 126 from the lip 120 (FIG. 8) of an adjacent module 102, the spring element 128 becomes loaded. When the body element 124 is released, the spring element 128 will react against the module to force the latching element 126 to engage the lip 120 of the adjacent module 102. Accordingly, the secondary connecting structure 116 will be biased in a latching position. The spring element 128 may be an integrally formed element with spring characteristics as shown or may be a separate element, such as a coiled spring, leaf spring, or other type of well known mechanical spring.

The latching element 126 is shown to be attached to the body element 124 opposite the spring element 128 and may engage the lip 120 of an adjacent module 102 when placed next to one another. According to one embodiment, the latching element 126 may include a slope or wedge so that as modules 102 are engaged with one another the slam latch 118 of one automatically engages the lip 120 of the other. The latching element 126 is square on the opposite face so that some action is required to release the slam latch 118 and separate the modules 102. Other arrangements, including a pincer mechanism, a clip, or other arrangements are anticipated as substitutes for the latching element 126 and lip 120.

Finally, the body element 124 of the slam latch 118 may include a hollow 130 for receiving a hand or other tool. This hollow 130 allows for an operator or assembler to insert a hand or tool into the slam latch 118, disengage the latching element 126 from the lip 120, and lift the attached module 102' to separate it from an adjacent module 102". The first module 102' may then be lifted, thereby disengaging the vertical protrusions 110 from the vertical grooves 114. While the hollow 130 is one manifestation of this function, it is contemplated that other variations may also be used. For example, the body element 124 may include a handle that may be grasped, a socket for receiving a tool, or other type of arrangement so that the slam latch 118 may be disengaged.

It is preferred that the slam latch 118 be designed so that the slam latch 118, when inserted into the recess 122, does not protrude above the lattice structure 106. Were the slam latch 118 to protrude above the lattice structure 106, the pallet assembly 100 may be unlevel and not suitable for storage. The secondary connecting structure 116 is preferably also designed to be positioned at an accessible distance at the intersection between the first 102' and second 102" modules so that a single person may disengage the slam latches 118 without undue strain. The number and location of the secondary connecting structure 116 relative to the vertical projections 110 and grooves 114 in the attached figures are shown for illustrative purposes only. Those having skill in the art will appreciate that the number, location, or arrangement of the secondary connecting structure 116 may vary in number, form, location, and appearance.

Also disclosed is a novel method for using the above-described modules to form a full pallet for storage or transport of goods. In order to perform this method, two pallet modules 102 may be provided, each having a first side 108 having at least one vertical projection 110 and a second side 112 having at least one vertical groove 114 for receiving the vertical projection 110 of an adjacent module 102 in an interlocking fashion. The module 102 also includes a secondary connecting structure 116 that may include a slam latch 118 adjacent the first side 108 and a lip 120 adjacent the second side 112.

The first pallet module 102' is positioned above and behind the second pallet module 102" such that the vertical projection 110 of the first module 102' aligns with the vertical groove 114 of the second module 102". The first module 102' is then lowered so that the vertical projection 110 is inserted into the vertical groove 114, thereby coupling the first 102' and second 102" modules to one another. As the modules are coupled, the lip 120 may deflect the latching element 126 of the slam latch 118, moving the slam latch 118 to a loaded position. Once the modules have reached a fully coupled position (when the vertical projection 110 reaches the stop 140), the spring element 128 of the slam latch 118 acts against the recess 122 to return the slam latch 118 to an unloaded position where the latching element 126 engages the lip 120 to prevent vertical movement of the second module 102" relative to the first 102'. This process provides a pallet section 100 formed of interlocking pallet modules 102.

It will be understood that due to the uniformity of the modules 102, the above-described method may be performed multiple times to form a pallet having a desired size.

What is claimed is:

1. An expandable modular interlocking pallet system comprising:

a plurality of elongated modules each sized to be a fraction of a desired pallet size, each module forming a support of such strength for a load, each module further having on a first side at least two female tracks and a second side opposite the first side at least two male tracks such that the female tracks and male tracks of adjacent modules are adapted to interlock as desired to assemble a pallet of said desired pallet size;

each elongated module also having at least one slam latch and a striker, wherein said slam latch is nested in the elongated module and adapted to be mechanically biased against the striker of an adjacent module, to engage the striker of the adjacent module, and to inhibit vertical separation of the modules to lock the modules together to form said pallet, and to disengage the striker to permit disassembly of the elongated module as desired; and each elongated module also having passageways adapted to permit placing of forks of a fork lift under the modules as assembled into said pallet.

2. The expandable modular interlocking pallet system as set forth in claim 1 wherein each module includes a notch adapted to receive a strap tie extended between the first and second sides and around a load positioned on the pallet.

3. The expandable modular interlocking pallet system as set forth in claim 1 wherein each male track is U-shaped with extending tabs to engage the female tracks of an adjacent module.

4. The expandable modular interlocking pallet system as set forth in claim 1 wherein each elongated module comprises three female tracks and three male tracks positioned on said first and second sides.

5. The expandable modular interlocking pallet system as set forth in claim 4 wherein each slam latch is mechanically biased against the striker of an adjacent module.

6. The expandable modular interlocking pallet system as set forth in claim 4 wherein each slam latch is mechanically biased with a mechanical spring.

7. The expandable interlocking modular pallet system as set forth in claim 1 wherein each module has at least two slam latches nested therewith and two strikers, the slam latches adapted to engage strikers of adjacent modules.

8. The expandable modular interlocking pallet system as set forth in claim 1 wherein each slam latch is mechanically biased with a mechanical spring.

9. The expandable modular interlocking pallet system as set forth in claim 1 where end portions of each module are angular to enable the elongated modules to nest and be stacked on each other.

10. The expandable modular interlocking pallet system as set forth in claim 1 where each module have a lattice array of such strength to support a load.

11. The module as set forth in claim 10 further comprising at least one passageway adapted to permit a fork for lifting module.

12. The module as set forth in claim 11 wherein said passageway extends through each of said sidewalls.

13. The module as set forth in claim 12 further comprising a crossbanding notch for receiving and preventing slippage of a band extending from one sidewall to the other, securing a load to said module.

14. The module as set forth in claim 11 wherein said passageway extends between said first and second sides and aligns with a corresponding passageway on said adjacent module.

15. A module for engaging an adjacent module in an expandable modular interlocking pallet system, each module comprising:

a lattice structure extending between a first and second side, and two sidewalls, said lattice structure for supporting a load placed on said module;

a plurality of vertical projections extending from said first side, each vertical projection having a profile adapted to lock said module to said adjacent module;

a plurality of vertical groove extending along said second side, each vertical groove having a complementary profile to the profile of said vertical projection and adapted to be interlocked with a vertical projection on an adjacent module;

a plurality of strikers adjacent one of said first or second sides; and a plurality of slam latches on said first or second opposite the side engaging the plurality of strikers to inhibit vertical separation of the modules, said slam latch movable by mechanical bias between a locked position engaging the striker of said adjacent module and an unlocked position where said striker of said adjacent module is not engaged.

16. The module as set forth in claim 15 wherein said vertical groove includes a stop for limiting travel of said vertical projection through said vertical groove.

17. The module as set forth in claim 15 wherein said sidewalls are sloped so as to allow one module to be stacked on another in a nesting relationship.

18. The module as set forth in claim 15 wherein said slam latch includes a spring element that biases said slam latch in a locked position.

19. The module as set forth in claim 18 wherein said slam latch further includes a latching element that engages said striker on said adjacent module.

20. A method of assembling modular pallet of a desired size, the method comprising:

providing a plurality of modules, wherein each module includes a structure adapted to support a load, a first side having at least two male connector, a second side opposite the first side having at least two female connector having a stop, a slam latch adjacent one of said first and second sides, and a striker adjacent one of said first and second sides opposite the side where the slam latch is located;

positioning a first module on a surface;

positioning a second module adjacent said first module so that the first side of said second module is adjacent said second side of said first module;

engaging said male connector into said female connector until said male connector impacts said stop;

engaging said striker on said first or second module with the slam latch of the other of said first or second module by mechanically biasing the slam latch against the striker so as to inhibit vertical separation of the modules; and assembling additional modules until the pallet has reached said desired size.

21. A modular pallet system including modules each having a support structure, male connectors on a first side, female connectors on a second side opposite said first side, and a slam latch adjacent said first or second side, wherein said male connectors engage said female connectors to couple adjacent modules to one another, wherein the slam latch comprises:

a housing;

a latching element extending from said housing; and a spring element extending from said housing opposite said latching element;

wherein said spring element mechanically biases said latching element in a locked position against a striker of an adjacent module.

22. The modular pallet system as set forth in claim 21, wherein the housing of the slam latch further comprises an aperture adapted for applying a force to disengage the latching element from the striker of the adjacent module.

* * * * *